US011242981B2

(12) United States Patent
Collado et al.

(10) Patent No.: US 11,242,981 B2
(45) Date of Patent: Feb. 8, 2022

(54) RECESSED LIGHTING FIXTURE

(71) Applicant: QTran, Inc., Milford, CT (US)

(72) Inventors: Justin Collado, Bridgeport, CT (US); Cliff Redner, Orlando, FL (US); Michael Kelley, Guilford, CT (US)

(73) Assignee: QTran, Inc., Milford, CT (US)

( * ) Notice: Subject to any disclaimer, the term of this patent is extended or adjusted under 35 U.S.C. 154(b) by 0 days.

(21) Appl. No.: 16/682,623

(22) Filed: Nov. 13, 2019

(65) Prior Publication Data

US 2020/0149716 A1 May 14, 2020

Related U.S. Application Data

(60) Provisional application No. 62/760,188, filed on Nov. 13, 2018.

(51) Int. Cl.
*F21V 21/04* (2006.01)
*F21S 8/02* (2006.01)

(52) U.S. Cl.
CPC ..... *F21V 21/048* (2013.01); *F21S 8/026* (2013.01)

(58) Field of Classification Search
CPC ..... F21V 21/048; F21S 8/026
See application file for complete search history.

(56) References Cited

U.S. PATENT DOCUMENTS 3,648,981 A 3/1972 Allen
4,054,268 A 10/1977 Sher
4,155,540 A 5/1979 Horgan, Jr.
4,586,697 A 5/1986 Tornya
4,690,383 A 9/1987 Batcheller
4,920,717 A 5/1990 Hooper, Jr.
5,200,240 A 4/1993 Baker
D353,467 S 12/1994 Raynes
D378,432 S 3/1997 Raynes
5,649,688 A 7/1997 Baker
6,419,209 B1 7/2002 Shepherd
D509,906 S 9/2005 Enersen
7,618,210 B2 11/2009 Wagner et al.
(Continued)

FOREIGN PATENT DOCUMENTS

CN 206655414 U * 11/2017
CN 207499276 U * 6/2018
DE 102016117157 B3 2/2018

OTHER PUBLICATIONS

International Search Report and Written Opinion of the International Searching Authority, PCT/US19/61199 (dated Feb. 19, 2020).

*Primary Examiner* — Mary Ellen Bowman
(74) *Attorney, Agent, or Firm* — Ware, Fressola, Maguire & Barber LLP

(57) ABSTRACT

A lighting fixture is provided that may include a channel configured for disposition at least partially within a recessed groove. The channel may be configured for mounting in the recessed groove by one or more fasteners, brackets and/or a combination of both fasteners and brackets. The lighting fixture may further include a mounting tray positioned within the channel and configured for mounting of a lighting element. The lighting fixture may also include a lens, for example a flexible lens, disposed at least partially within the channel and configured to at least partially cover the lighting element.

20 Claims, 22 Drawing Sheets

(56) References Cited

U.S. PATENT DOCUMENTS

| | | | | |
|---|---|---|---|---|
| 7,677,504 | B2 | 3/2010 | Hutchinson et al. | |
| 7,730,682 | B2 | 6/2010 | Nash | |
| 7,815,389 | B2 | 10/2010 | Wagner et al. | |
| 8,181,405 | B2 | 5/2012 | Nash | |
| 8,235,623 | B2 | 8/2012 | Wagner et al. | |
| 8,757,566 | B2 | 6/2014 | Nash | |
| 2002/0195595 | A1 | 12/2002 | Shepherd | |
| 2005/0141225 | A1* | 6/2005 | Striebel | F21S 4/28 362/382 |
| 2006/0284154 | A1* | 12/2006 | Sprague | E04F 11/1812 256/59 |
| 2009/0296381 | A1 | 12/2009 | Dubord | |
| 2010/0091494 | A1* | 4/2010 | Pearson | F21V 33/006 362/249.02 |
| 2015/0345722 | A1* | 12/2015 | Cavaliere | F21V 17/107 362/382 |
| 2016/0298375 | A1 | 10/2016 | Wagner et al. | |
| 2018/0306413 | A1* | 10/2018 | Tremaine | F21S 4/22 |
| 2018/0320840 | A1* | 11/2018 | Machiis | F21V 23/003 |

* cited by examiner

RECESSED LIGHTING FIXTURE

CROSS-REFERENCE TO RELATED APPLICATIONS

This application claims priority to U.S. Provisional Appl. No. 62/760,188 filed Nov. 13, 2018, which is hereby incorporated by reference in its entirety.

BACKGROUND OF THE INVENTION

1. Field of the Invention

The present invention generally relates to recessed lighting fixtures, and more particularly to a light emitting diode (LED) lighting fixture configured for disposal within a railing, banister, foot rail, fence and/or barrier in order to provide illumination.

SUMMARY OF THE INVENTION

Exemplary embodiments of the present invention are directed to recessed lighting fixtures which may be used in connection with railings, banisters, foot rails, fences and/or other barriers in order to provide illumination.

It is an object of the present invention to provide a lighting fixture configured for disposition within a railing, foot rail, fence and/or barrier in order to provide illumination for the areas adjacent to the railing, foot rail, fence and/or barrier.

It is an object of the present invention to provide a lighting fixture for providing illumination to the areas adjacent to a railing, foot rail, fence and/or barrier without substantially impacting the size, dimensions, configuration and/or atheistic appearance of the railing, foot rail, fence and/or barrier.

It is another object of the present invention to provide a lighting fixture that is customizable in its dimensions to fit a variety of applications.

It is yet another object of the present invention to provide a lighting fixture having a wire way disposed therein.

It is still another object of the present invention to provide a lighting fixture configured for ease of installation, but permanence in environments subjected to repeated abuse.

It is another object of the present invention to provide a substantially water tight and/or water proof lighting fixture for use in wet and/or moist environments.

It is yet another object of the present invention to provide a substantially dust-proof and/or dust-proof lighting fixture for use in areas where dirt and debris may be present.

It is still another object of the present invention to provide a lighting fixture having a flexible lens so that the lighting fixture is configured to illuminate angular transitions. It is another object of the present invention to provide a lighting fixture configured to provide illumination through angular transitions.

It is still another object of the present invention to provide a flexible lighting fixture configured for multidirectional bending.

In accordance with various aspects of the present invention, a lighting fixture is provided that may include a channel configured for disposition at least partially within a recessed groove. The channel may be configured for mounting in the recessed groove by one or more fasteners, brackets and/or a combination of both fasteners and brackets. The lighting fixture may further include a mounting tray positioned within the channel and configured for mounting of a lighting element. The lighting fixture may also include a lens, for example a flexible lens, disposed at least partially within the channel and configured to at least partially cover the lighting element.

In accordance with an exemplary embodiment of the present invention, a lighting fixture may include a channel having a bottom portion, a pair of side portions extending from the bottom portion, and an opening formed between the side portions opposite the bottom portion, a lighting element disposed within the channel, and a lens at least partially covering the lighting element. In accordance with this and other exemplary embodiments of the present invention, the channel of the lighting fixture may be configured for disposition within a groove that encloses at least the bottom portion, and at least a portion of the pair of side portions, and the channel of the lighting fixture may be configured for attachment to the groove.

In accordance with this and other exemplary embodiments of the present invention, the groove may be disposed within a hand railing, foot railing, bannister, fence or other barrier.

In accordance with this and other exemplary embodiments of the present invention, the lighting fixture may also include a mounting tray disposed within the channel and configured to retain the lighting element positioned thereon.

In accordance with this and other exemplary embodiments of the present invention, the lens may be made from a flexible material.

In accordance with this and other exemplary embodiments of the present invention, the lighting fixture may also include one or more furrows extending at least partially along at least one of the pair of side portions of the channel.

In accordance with this and other exemplary embodiments of the present invention, the lens may be made from a flexible material, and the one or more furrows may be configured to engage with the retain the lens in the channel.

In accordance with this and other exemplary embodiments of the present invention, the lighting element may also include one or more sets of extensions extending from each side of the pair of sides, where each of the one or more sets of extensions may be configured to support a mounting tray disposed within the channel.

In accordance with this and other exemplary embodiments of the present invention, the mounting tray may be configured to retain the lighting element thereon, and a wire way may be formed in the channel between the mounting tray and the bottom of the channel.

In accordance with this and other exemplary embodiments of the present invention, the lighting fixture may configured for attachment to the groove through the use of one or more fasteners.

In accordance with this and other exemplary embodiments of the present invention, the lighting fixture may be configured for attachment to the groove through the use of one or more mounting brackets.

In accordance with this and other exemplary embodiments of the present invention, the one or more mounting brackets may be secured to the channel through the use of one or more fasteners.

In accordance with this and other exemplary embodiments of the present invention, the one or more mounting brackets may be configured for engagement with one or more endcaps affixed to the channel.

In accordance with this and other exemplary embodiments of the present invention, wherein the lighting fixture may also include one or more teeth extending at least partially along at least one of the pair of side portions of the channel.

In accordance with this and other exemplary embodiments of the present invention, the lens may be made from a flexible material, and the one or more furrows are configured to engage with the retain the lens in the channel.

In accordance with this and other exemplary embodiments of the present invention, the channel may include one or more longitudinal grooves positioned on an exterior area of at least one of the pair of side portions.

In accordance with this and other exemplary embodiments of the present invention, the channel may also include a rounded transition between each of the pair of side portions and the bottom portion.

In accordance with this and other exemplary embodiments of the present invention, the lighting element may be disposed on one of the side portions.

In accordance with this and other exemplary embodiments of the present invention, the channel may be comprised of a flexible material.

In accordance with this and other exemplary embodiments of the present invention, the channel may be comprised of a plastic.

In accordance with this and other exemplary embodiments of the present invention, the lighting element may be flexible.

BRIEF DESCRIPTION OF THE SEVERAL VIEWS OF THE DRAWINGS

For a fuller understanding of the nature and object of the present invention, reference should be had to the following detailed description taken in connection with the accompanying drawings, in which.

DETAILED DESCRIPTION OF THE INVENTION

Figure 1:
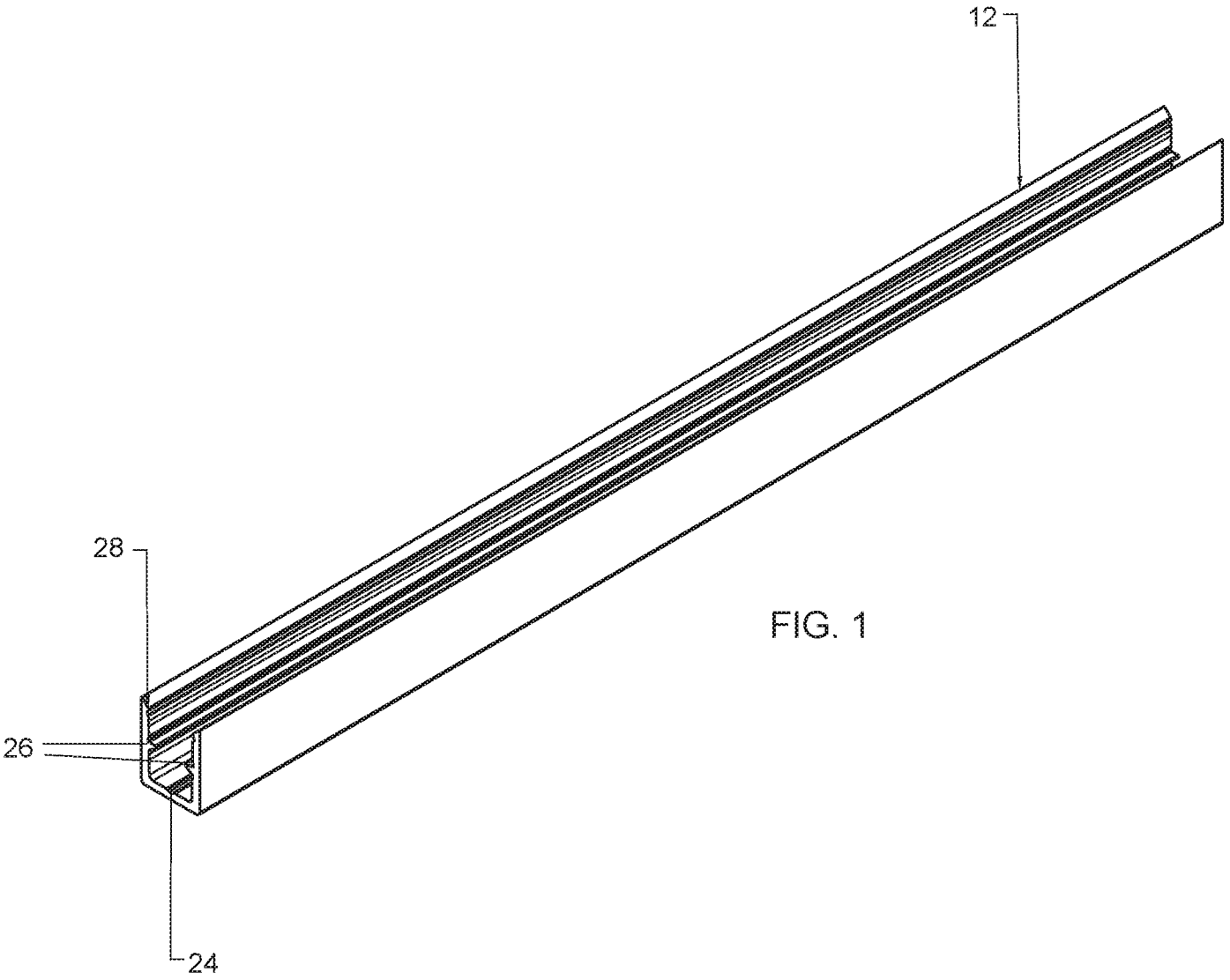
FIG. 1 is a top isometric view of an exemplary channel according to an exemplary aspect of the present invention.

The present invention now will be described more fully hereinafter with reference to the accompanying figures, in which exemplary embodiments of the invention are shown. The invention may, however, be embodied in many different forms and should not be construed as limited to the embodiments set forth herein. Like reference numerals refer to like elements throughout.

Figure 7:
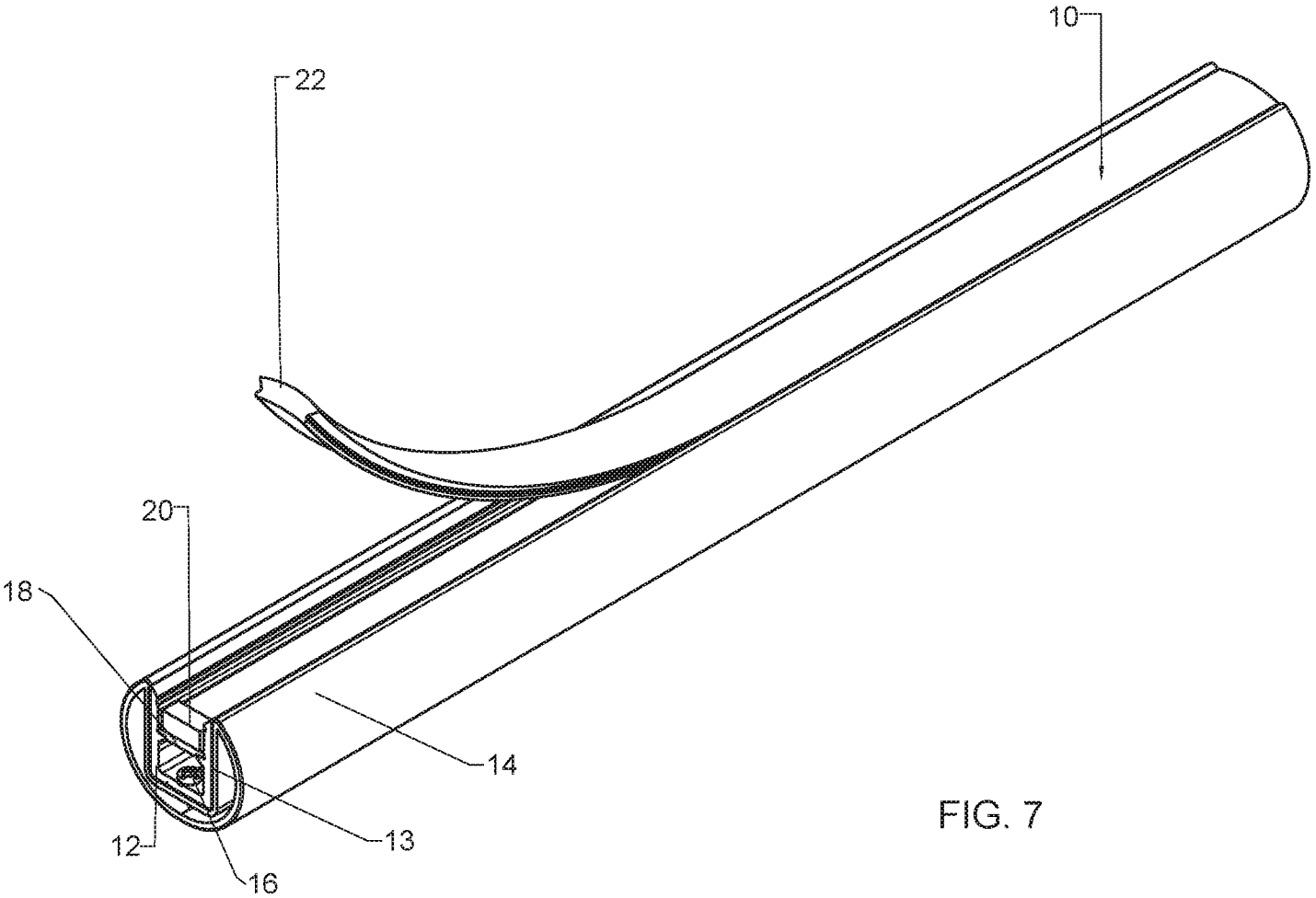
FIG. 7 is a top isometric view of an exemplary lens positioned within the exemplary channel shown in FIG. 1 to form an exemplary lighting fixture according to an embodiment of the present invention.
Figure 8:
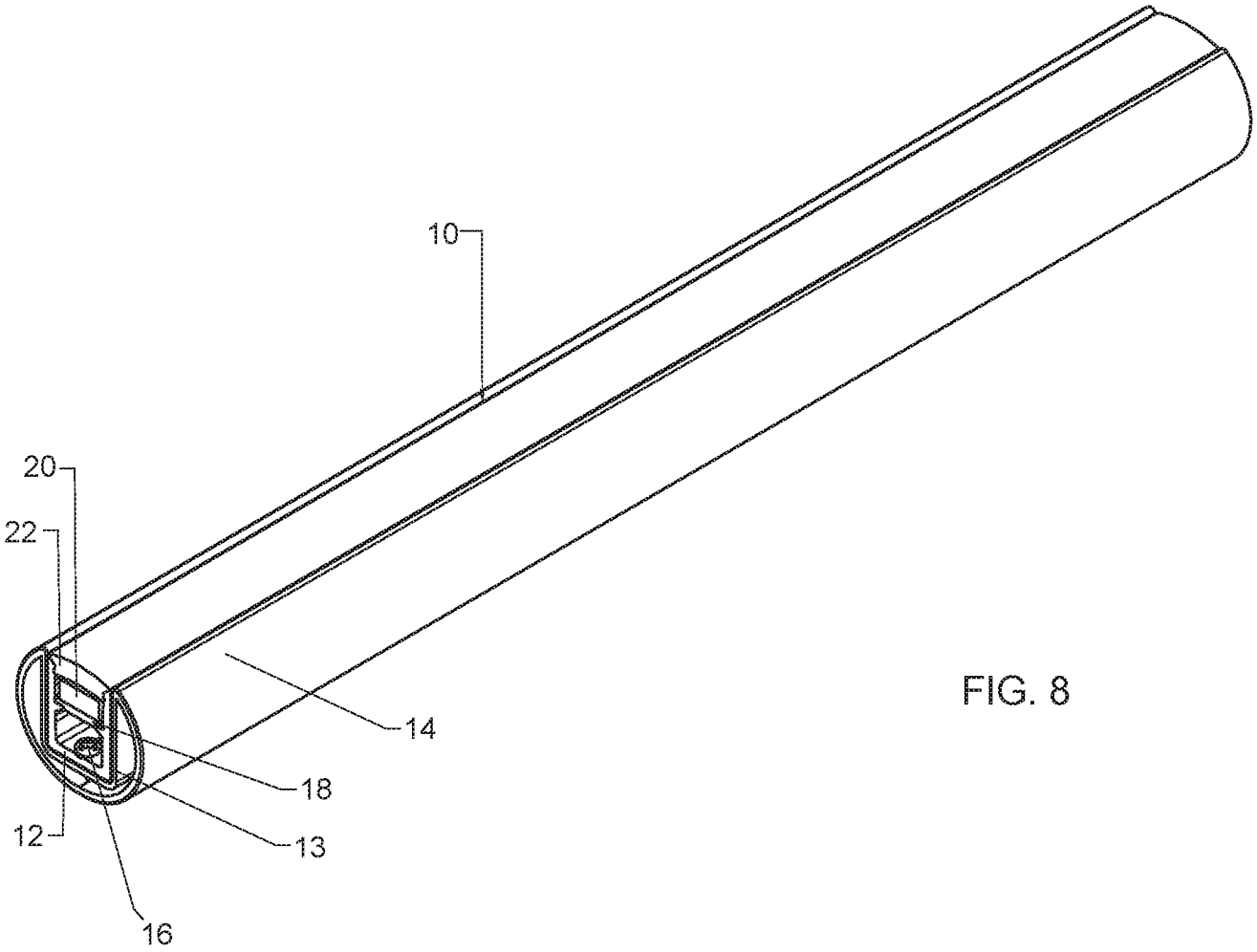
FIG. 8 is a top isometric view of the exemplary lighting fixture according to the present invention.
Figure 9:
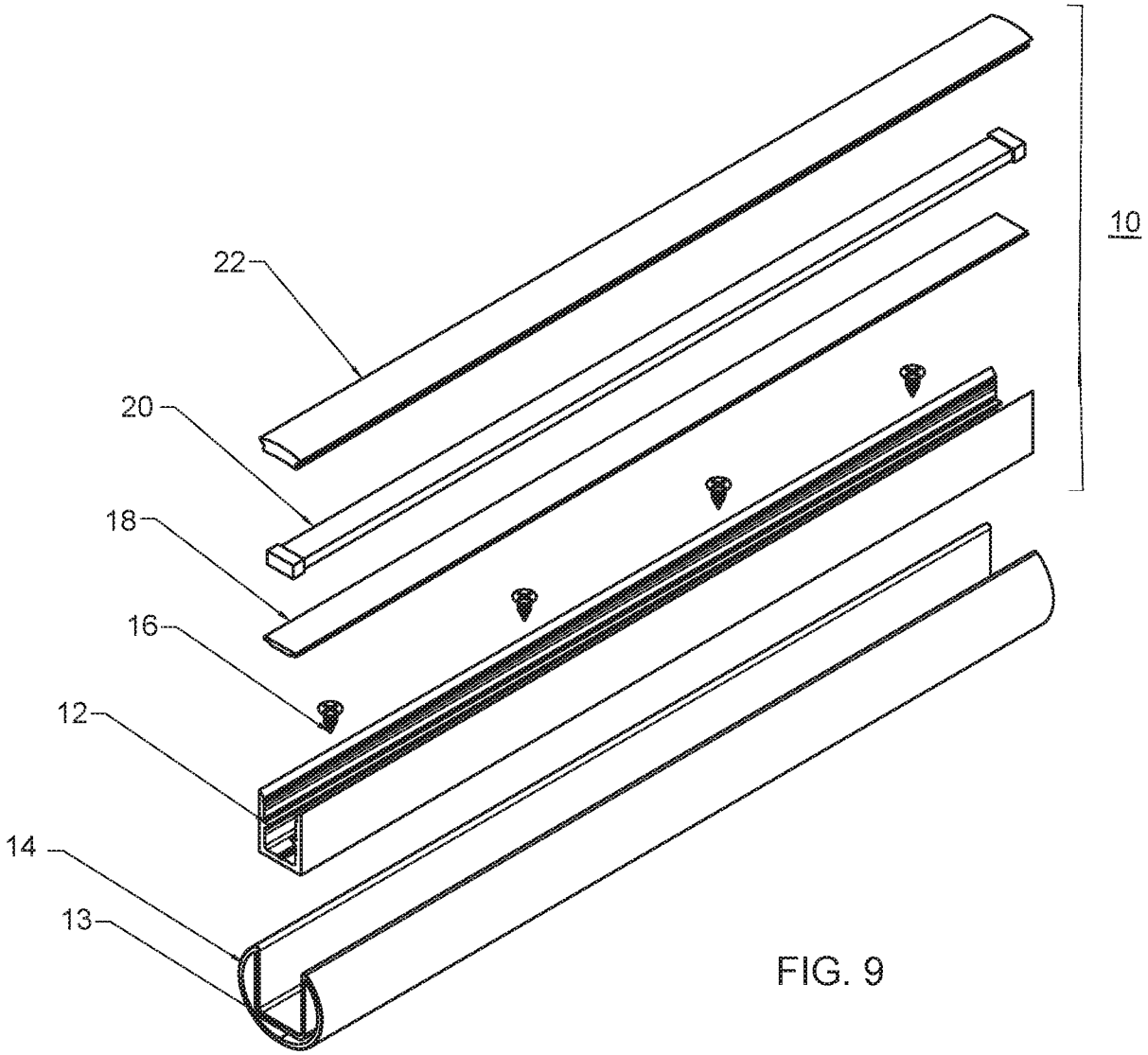
FIG. 9 is an exploded isometric view of the exemplary lighting fixture shown in FIG. 8.

Referring now to FIGS. 7-9, therein illustrated is an exemplary embodiment of a lighting fixture, generally indicated by reference numeral 10, according to an exemplary aspect of the present invention. The lighting fixture 10 may include a channel 12 configured and dimensioned for positioning within a recessed groove 13 formed in a portion of a railing 14. The railing 14 may be a hand railing, or other railing used to assist and/or support persons during their movement, travel and/or occupation of a particular area. It is understood that the lighting fixture 10 may also be configured for positioning within foot rails, bannisters, fences or other barriers, and may be used in any structure from which illumination may be desired. The channel 12 may be removably secured to the recessed groove 13 of the railing 14 by one or more fasteners 16, for example screws as shown in FIGS. 7-9. The lighting fixture 10 may also be secured to the recessed groove 13 of the railing 14 by an adhesive material, or dimensioned so as to be frictionally secured within the recessed groove 13 without becoming dislodged during normal use and operation of the railing 14. The lighting fixture 10 may also include a mounting tray 18 configured for positioning within the channel 12, and may further include a lighting element 20 disposed on the mounting tray 18 and configured to provide illumination for the lighting fixture 10. The mounting tray 18 may be configured for positioning at various heights within the channel 12, so that the illumination and illumination effects provided by the lighting element 20 may be adjusted depending upon the height of the mounting tray 18. It is understood that the mounting tray 18 may optionally be removed from the channel 12, and the lighting element 20 positioned at the bottom of the channel 12. The lighting element 20 may be a light emitting diode (LED) or equivalent lighting strip, and may be waterproof, water resistant, dust proof and/or dust resistant depending upon the environment in which the lighting fixture 10 may be desired to be used. The lighting fixture 10 may also include a lens 22 at least partially disposed within the channel 12 and configured to at least partially cover the lighting element 20. The lens 22 may be made from a flexible material, such as a flexible polyurethane.

Figure 2:
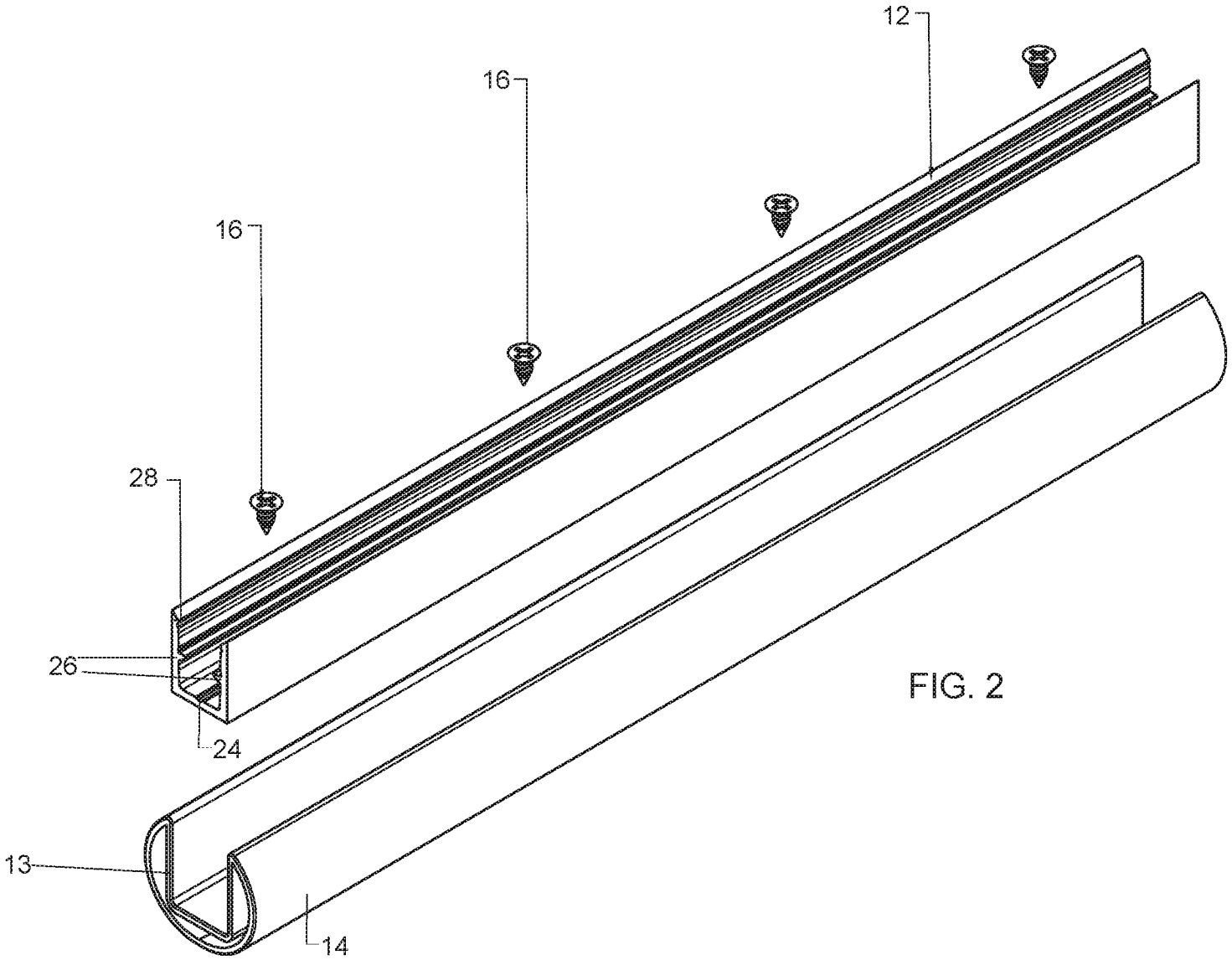
FIG. 2 is an exploded top isometric view of the exemplary channel shown in FIG. 1 demonstrating an exemplary installation of the channel within an exemplary railing.
Figure 3:
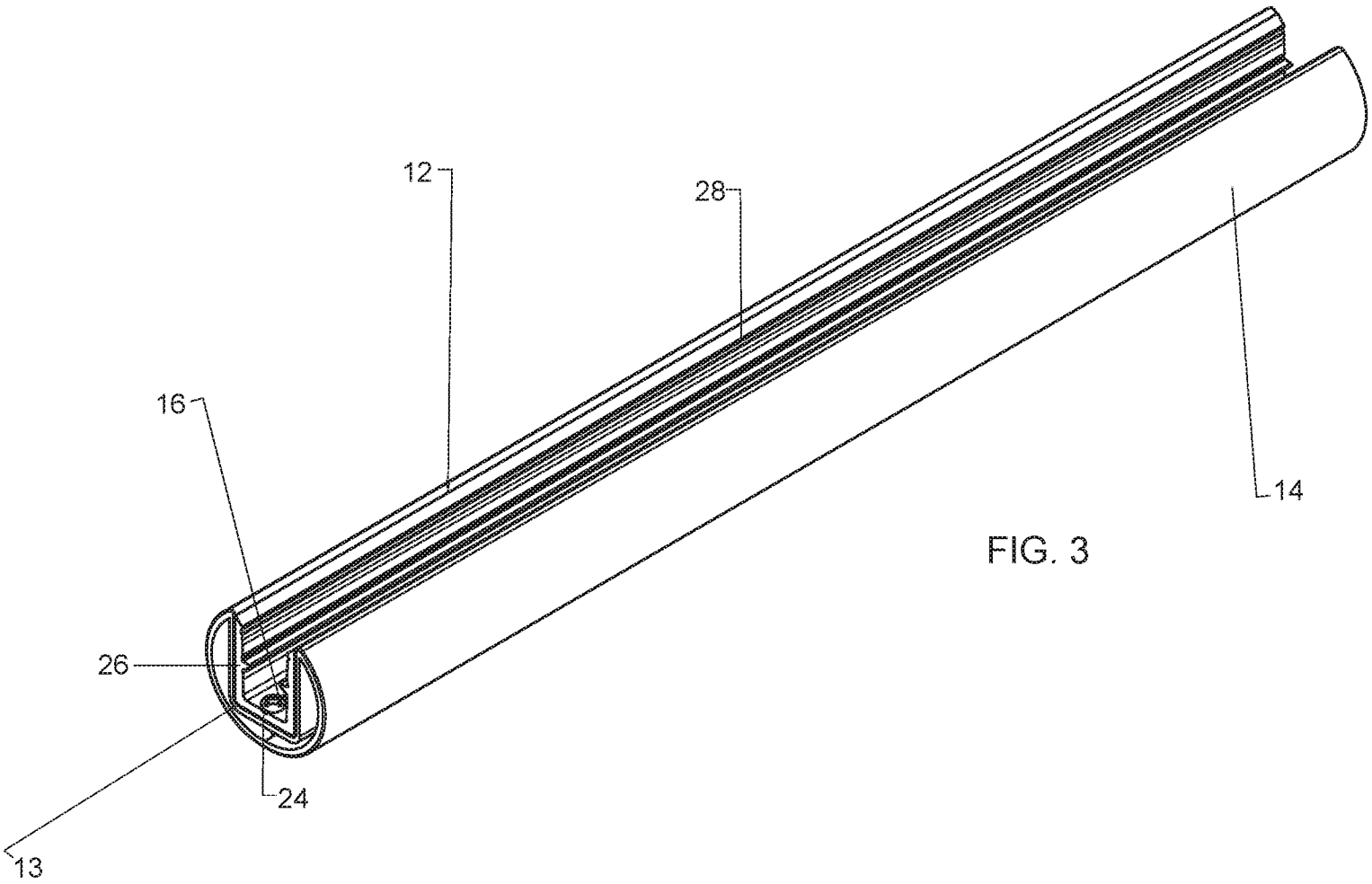
FIG. 3 is a top isometric view of the exemplary channel shown in FIG. 1 positioned within the exemplary railing.

Referring now to FIGS. 1-3, the channel 12 according to an exemplary aspect of the present invention will be discussed in greater detail. The channel 12 may be made from a plastic, such as polyvinyl chloride (PVC), or other suitable material that may be cut to the desired length during field installation of the channel 12 without the need for specialized and/or power operated tools or machines. However, it is understood that the channel 12 according to aspects of the present invention is not limited to plastics and/or field cuttable materials. For example, the channel 12 may be made from metals, such as aluminum. The channel 12 may include a recessed track 24 positioned in the base of the channel 12 and running at least partially the length of the channel 12. The recessed track 24 is configured to facilitate mounting of the channel 12 within the railing 14 by acting as an indent within the channel 12 for positioning of the one or more fasteners 16. The channel 12 may also include one or more set of extensions 26 protruding into the interior region of the channel 12 and configured to act as a base for the mounting tray 18 to be positioned on. The one or more set of extensions 26 may be positioned at various heights within the channel 12 to serve as a base for the mounting tray 18. It is understood that the mounting tray 18 may be positioned on the set of extensions 26 either by installing the mounting tray 18 through the top of the channel 12, or by sliding the mounting tray 18 onto one of the set of extensions 26 through an end of the channel 12. The area formed between the mounting tray 18 and the base of the channel 12 can serve as a wire way for one or more of the electrical conductors that distribute power to the lighting element 20. The channel 12 may also include one or more furrows 28 positioned between the extensions 26 and opening of the channel 12 configured to interlock with and facilitate retention of the lens 22 within the channel 12.

Figure 4:
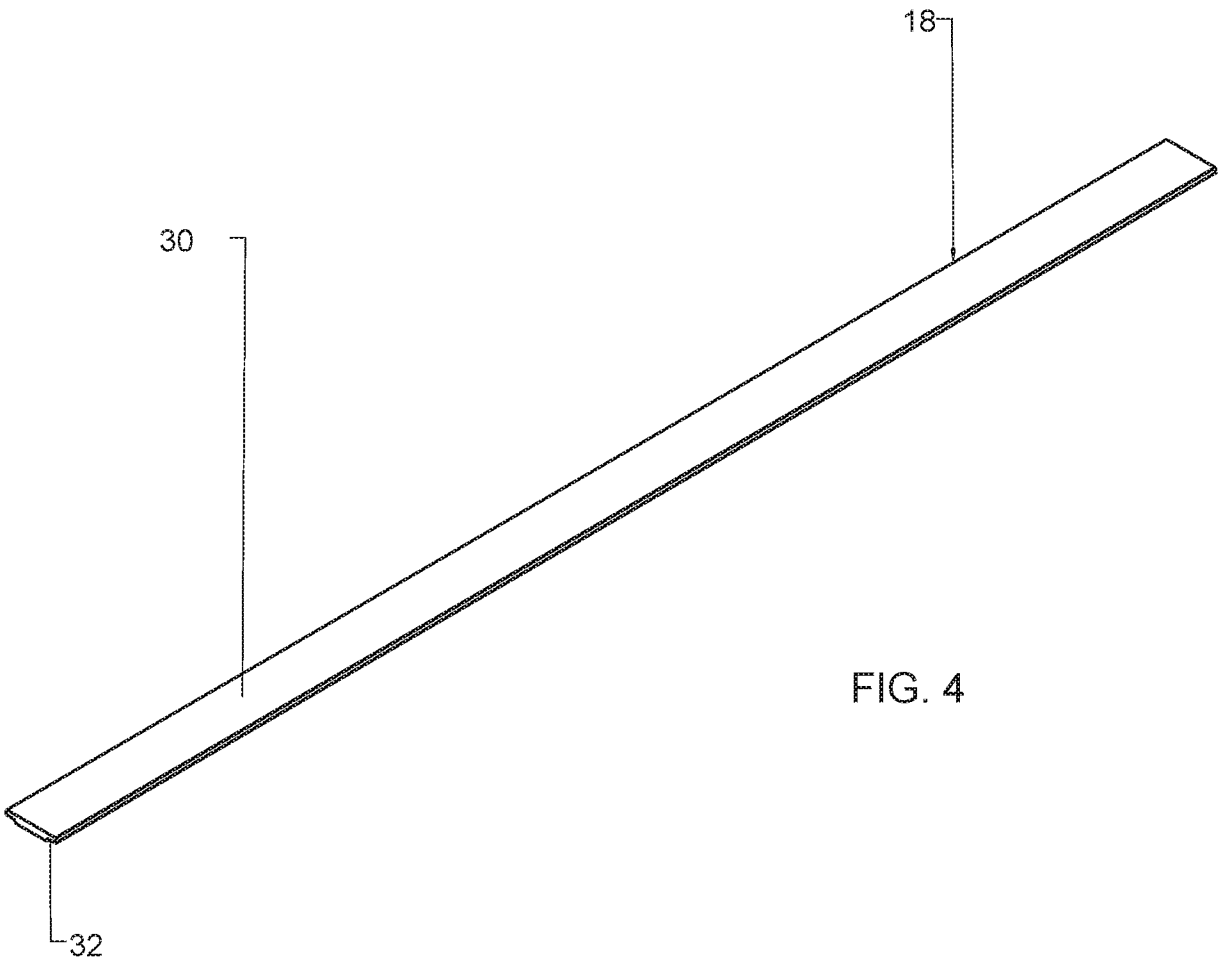
FIG. 4 is a top isometric view of an exemplary mounting tray according to an exemplary aspect of the present invention.
Figure 5:
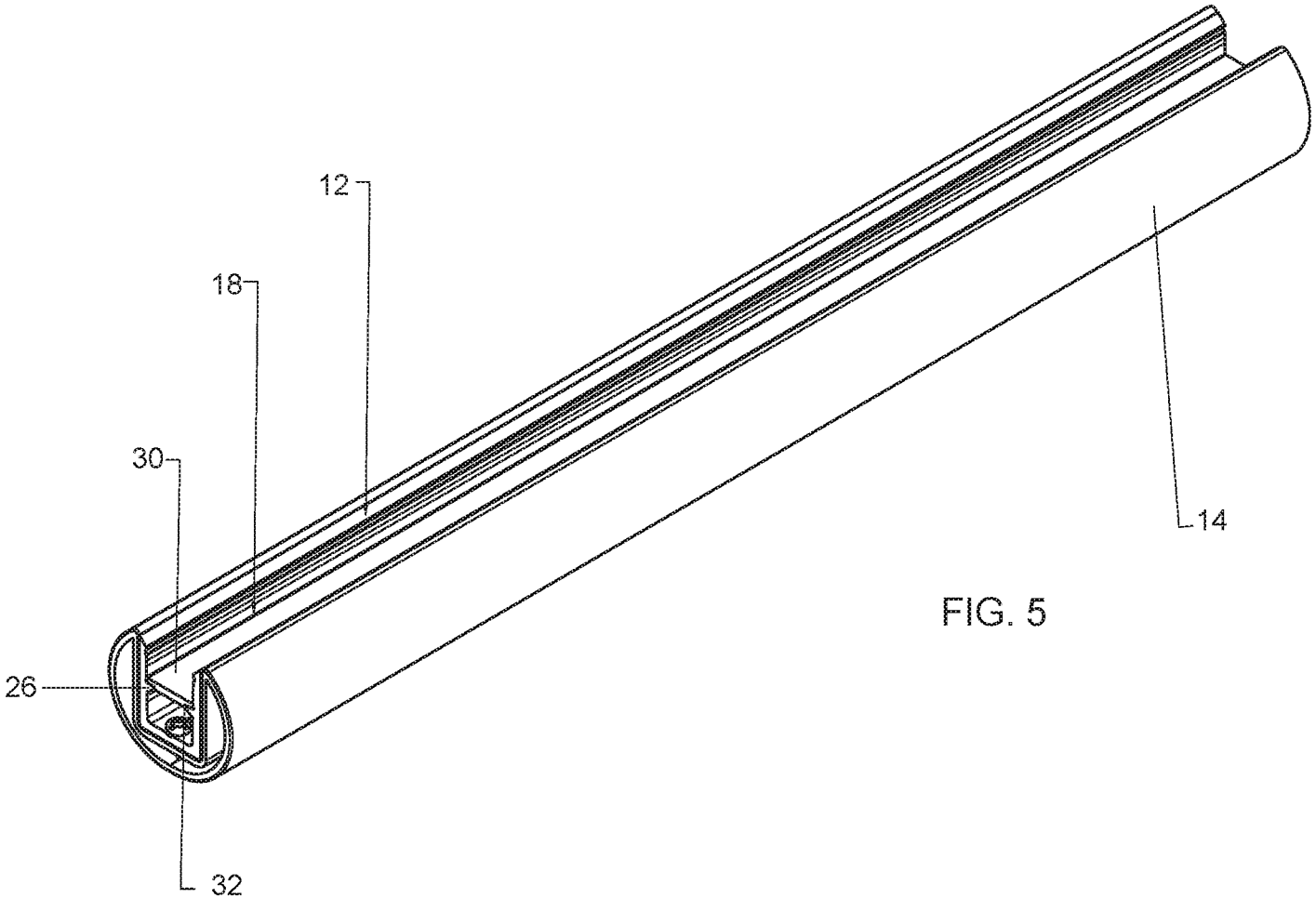
FIG. 5 is a top isometric view of the exemplary mounting tray shown in FIG. 4 positioned within the exemplary channel shown in FIG. 1 installed in the exemplary railing.
Figure 6:
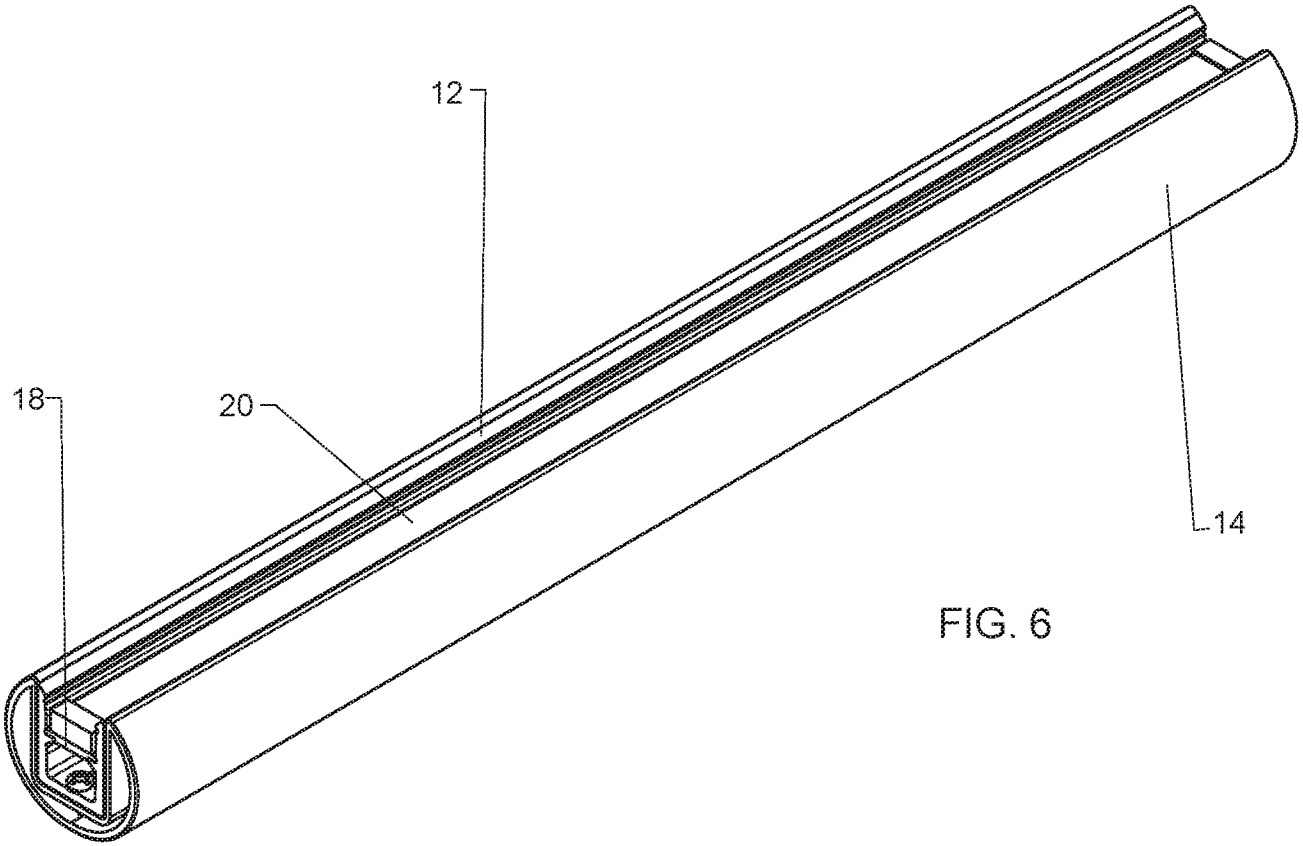
FIG. 6 is a top isometric view of an exemplary lighting element positioned within the exemplary channel shown in FIG. 1.

Referring now to FIGS. 4-6, the mounting tray 18 according to an exemplary aspect of the present invention will be discussed in greater detail. The mounting tray 18 may be made from a flexible plastic, for example PVC, or other easily field cuttable material. However, it is understood that the mounting tray 18 according to aspects of the present invention is not limited to plastics and/or field cuttable materials. For example, the mounting tray 18 may be made from metals, such as aluminum. The mounting tray 18 may include a surface 30 on which the lighting element 20 may be mounted, the lighting element 20 may be secured to the surface 30 through an adhesive (not shown), adhesive double-sided table (not shown) or other similar means. The side opposite the surface 30 of the mounting tray 18 may include one or more notches 32 configured to facilitate installation of the mounting tray 18 on the extensions 26 of the channel 12. The mounting tray 18 may be configured such that it can only be installed after the channel 12 is secured to the railing 13 by the fasteners 16, and such securing of the channel 12 to railing 14 causes the channel 12 to become slightly narrower to further retain the mounting tray 18 within the channel 12. The narrowing of the channel 12 may be as a result of the one or more fasteners 16 causing the bottom of the channel 12 to bow slightly away from the interior of the channel 12 thereby resulting in the sides of the channel 12 being drawn closer to each other resulting in an overall narrowing of the channel 12.

Figure 10:
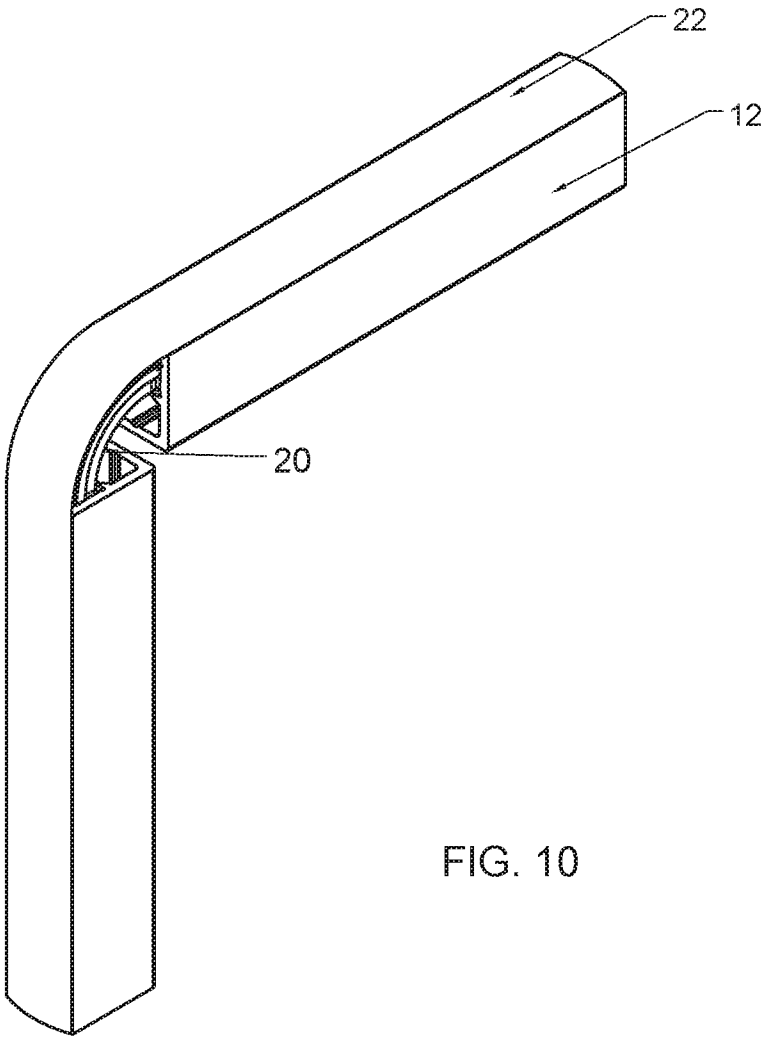
FIG. 10 is a top isometric view of an exemplary angular junction between exemplary channels shown in FIG. 1.
Figure 11:
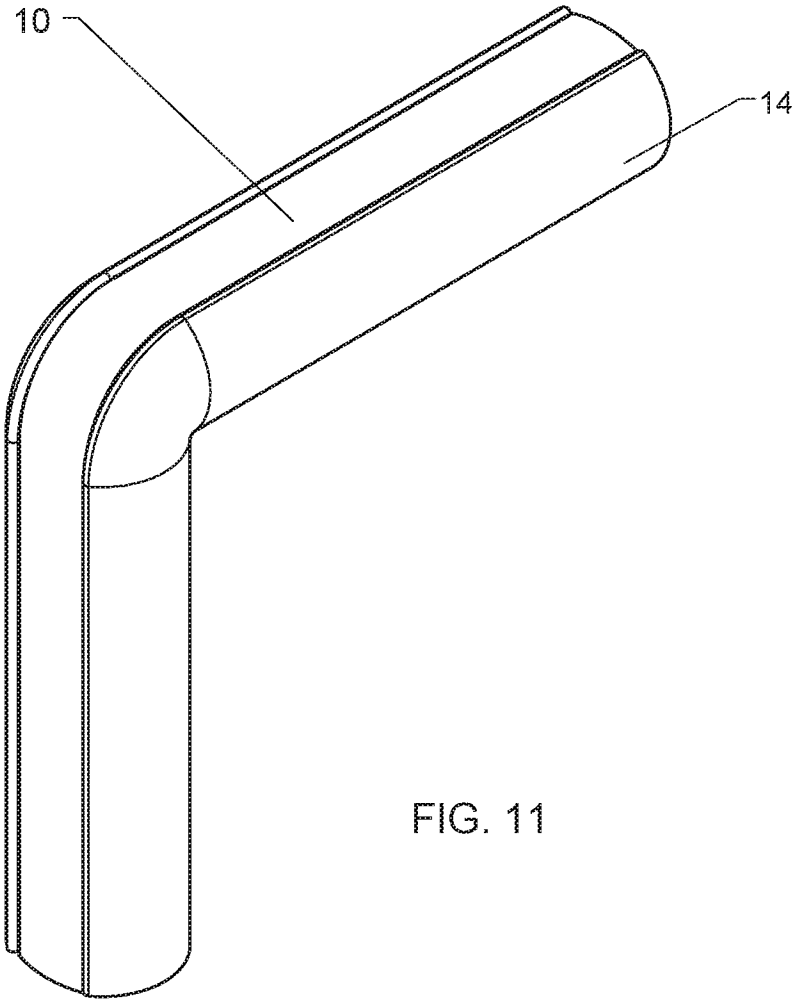
FIG. 11 is a top isometric view of an exemplary angular junction between exemplary lighting fixtures shown in FIG. 8.
Figure 12:
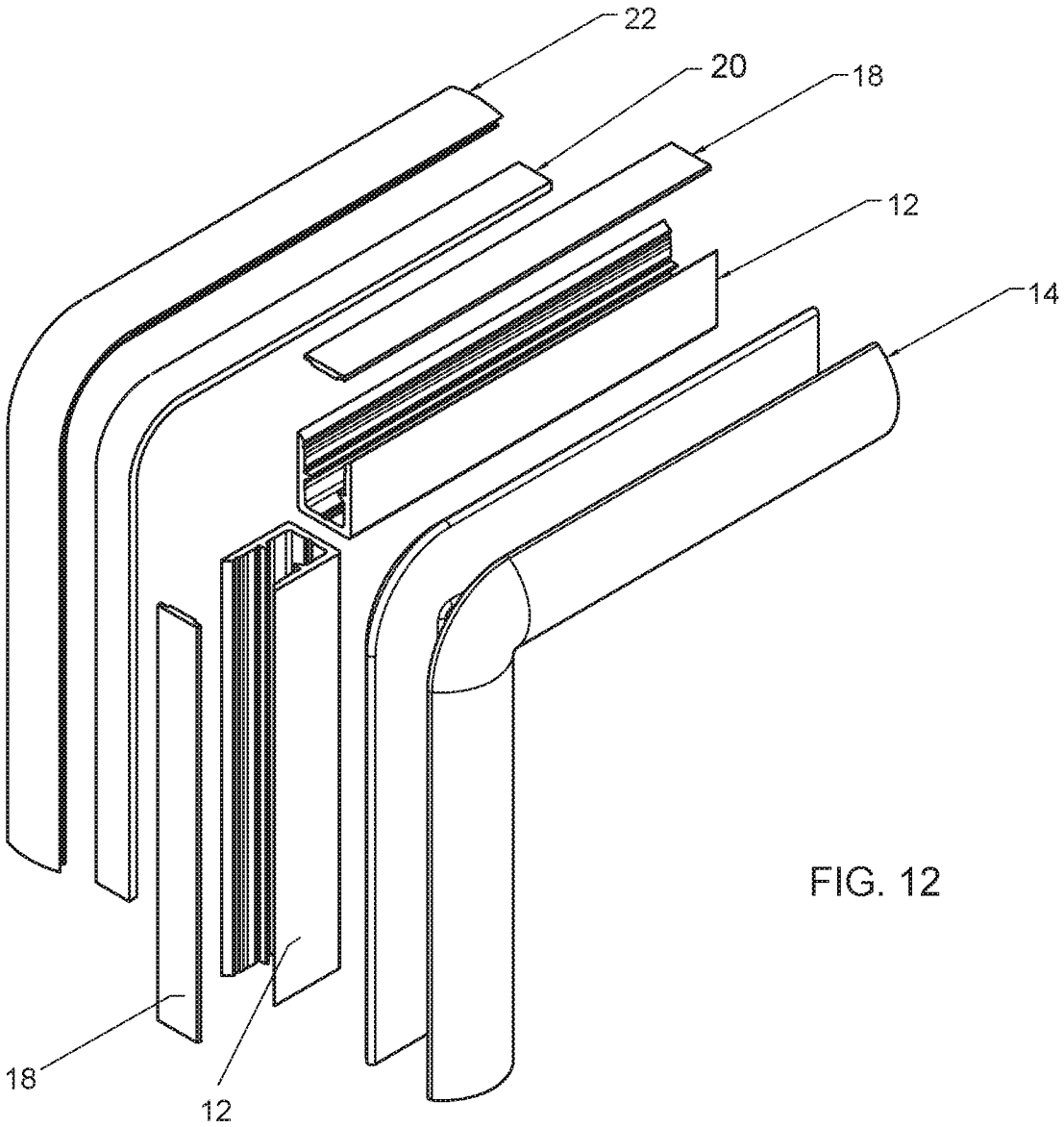
FIG. 12 is an exploded isometric view of the exemplary angular junction shown in FIG. 11.

Referring now to FIGS. 10-12, therein illustrated is an exemplary application of the lighting fixture 10 according to the present invention for use around a corner of an exemplary railing 14. As shown in FIG. 10, the channels 12 may be positioned at an angle relative to each other, and the lens 22 and lighting element 20 are configured to bridge the gap created by the angle between the channels 12 in order to create one unitary lighting fixture 10 as a result of the flexible natures of the lens 22 and lighting element 20. This allows the lighting fixture 10 to provide illumination on the angular transitions of the exemplary railing 14.

Figure 17:
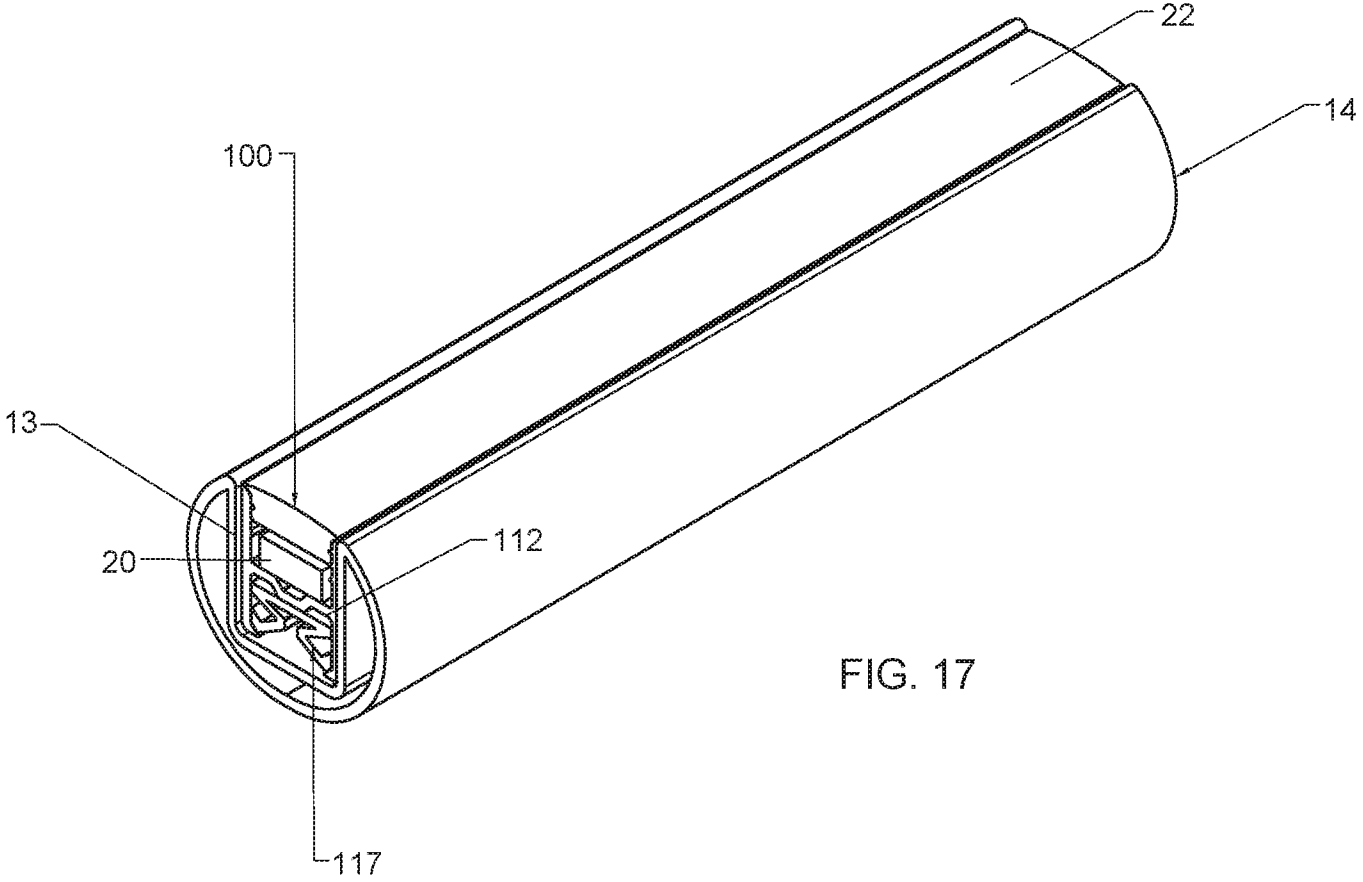
FIG. 17 is a top isometric view of an exemplary lens positioned within the exemplary channel shown in FIG. 13 to form an exemplary lighting fixture according to another embodiment of the present invention.

Referring now to FIGS. 13-17, therein illustrated is an alternative exemplary embodiment of the lighting fixture, generally referred as numeral 100 in FIG. 17. The lighting fixture 100 includes components and features similar to those discussed above with respect to lighting fixture 10, unless otherwise noted. However, it is understood that the components and/or features of lighting fixtures 10 and 100 are interchangeable, whether or not specifically discussed herein. The lighting fixture 100 includes a channel 112 configured and dimensioned for positioning within a portion of a railing 14. The railing 14 may be a hand railing, or other railing used to assist and/or support persons during their movement, travel and/or occupation of a particular area. It is understood that the lighting fixture 100 may also be configured for positioning within foot rails, bannisters, fences or other barriers, and may be used in any structure from which illumination may be desired. The channel 112 may be removably secured to the railing 14 by one or more fasteners 116 and brackets 117, as shown for example in FIGS. 14-15.

Figure 13:
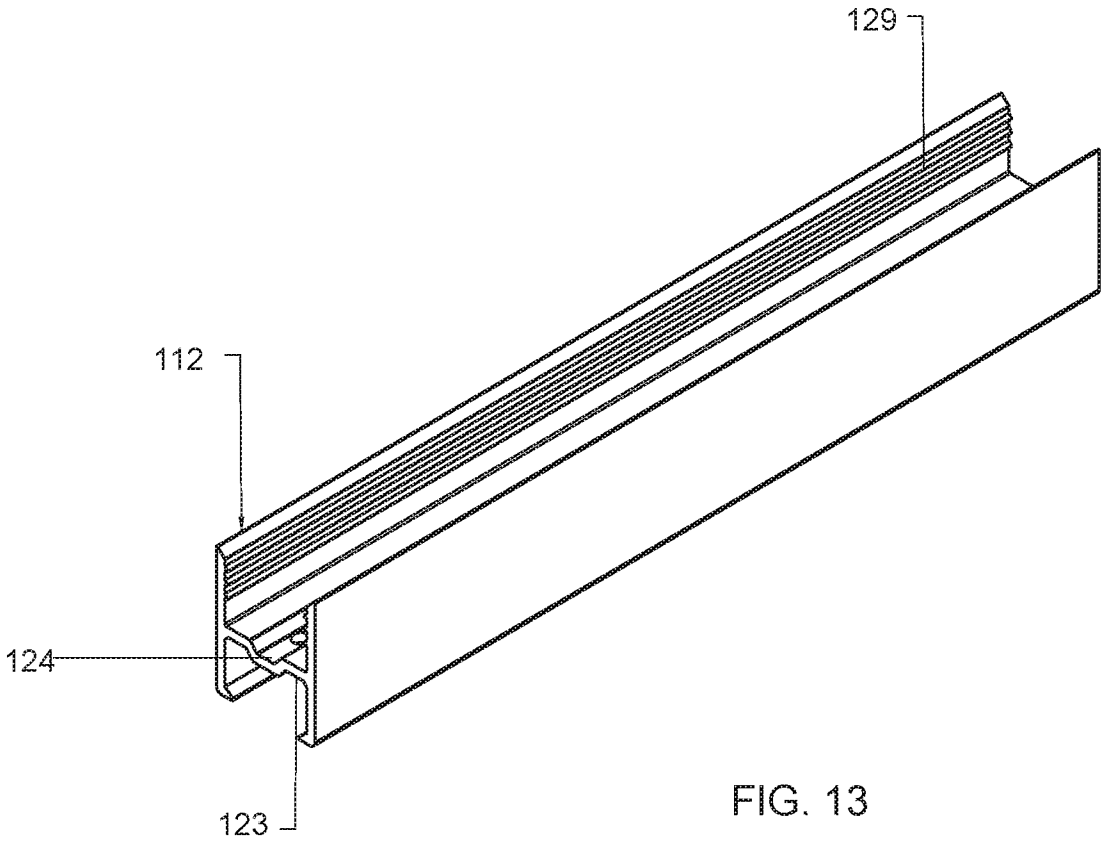
FIG. 13 is a top isometric view of an exemplary channel according to another exemplary aspect of the present invention.
Figure 14:
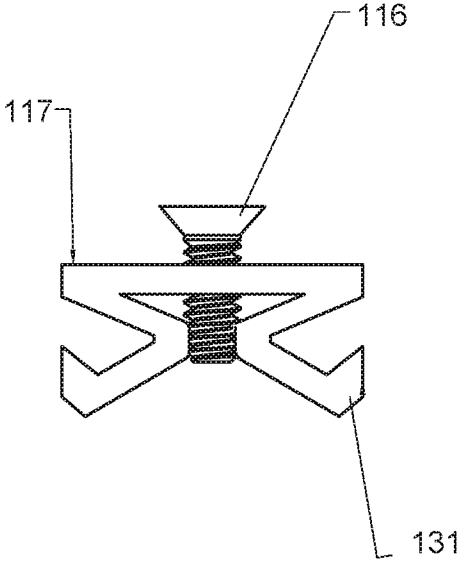
FIG. 14 is front view of an exemplary bracket according to an exemplary aspect of the present invention.
Figure 15:
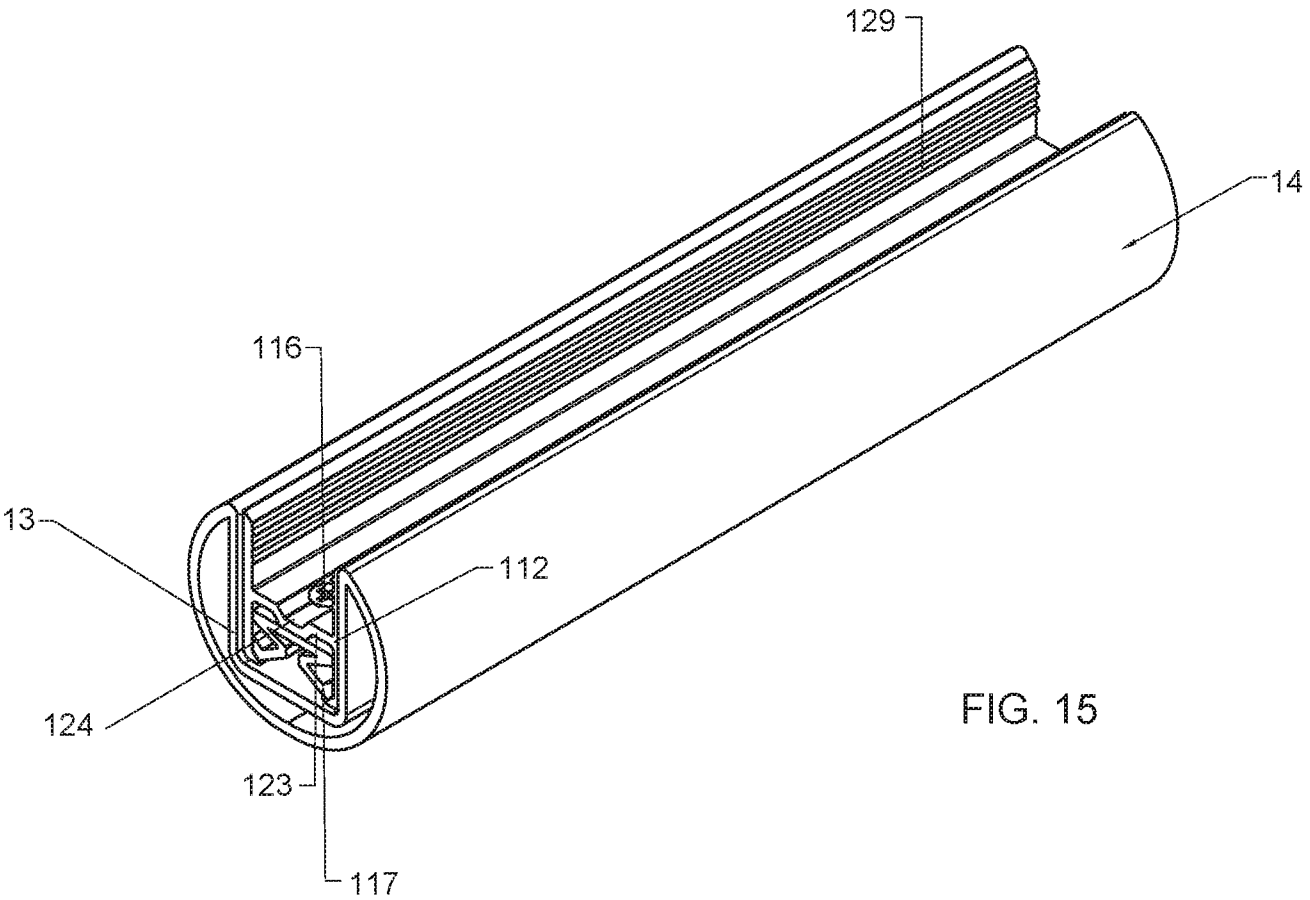
FIG. 15 is a top isometric view of the exemplary channel shown in FIG. 13 positioned within the exemplary railing.
Figure 16:
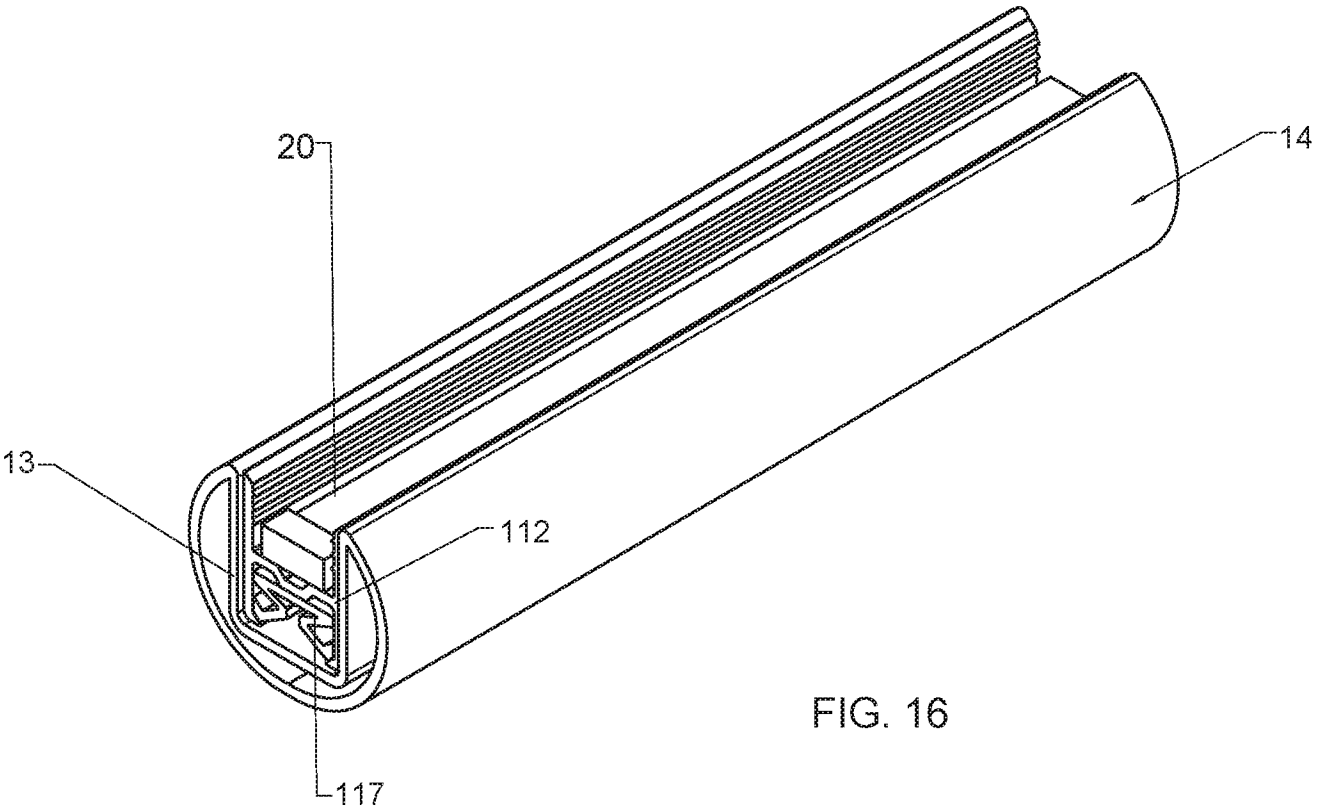
FIG. 16 is a top isometric view of an exemplary lighting element positioned within the exemplary channel shown in FIG. 13.

Referring now to FIGS. 13 and 15, the channel 112 according to an exemplary aspect of the present invention will be discussed in greater detail. The channel 112 may be made from a plastic, such as polyvinyl chloride (PVC), or other easily field cuttable material. However, it is understood that the channel 112 according to aspects of the present invention is not limited to plastics and/or field cuttable materials. For example, the channel 112 may be made from metals, such as aluminum. The channel 112 may include a platform 123 and a recessed track 124 positioned in the platform 123 running at least partially the length of the platform 123. The recessed track 124 is configured to facilitate mounting of the channel 112 by acting as an indent within the platform 123 for positioning of the one or more fasteners 116 so that the fasteners 116 are positioned at or below the surface of the platform 123. The channel 112 may also include one or more teeth 129 positioned between the platform 123 and opening of the channel 112, which teeth 129 are configured to interlock with and facilitate retention of the lens 22 within the channel 112. The one or more fasteners 116 are configured for operative engagement with one or more corresponding brackets 117 positioned between the platform 123 of the channel 112 and the recessed groove 13 of the railing 14. As the fasteners 116 are inserted through the platform 123 and into the brackets 117, the fasteners 116 force the wings 131 of the bracket 117 to expand towards the channel 112 walls, which in turn, causes the channel 112 walls to securely contact the recessed groove 13, such that the channel 112 is wedged into the recessed groove 13 of the railing.

Figure 18:
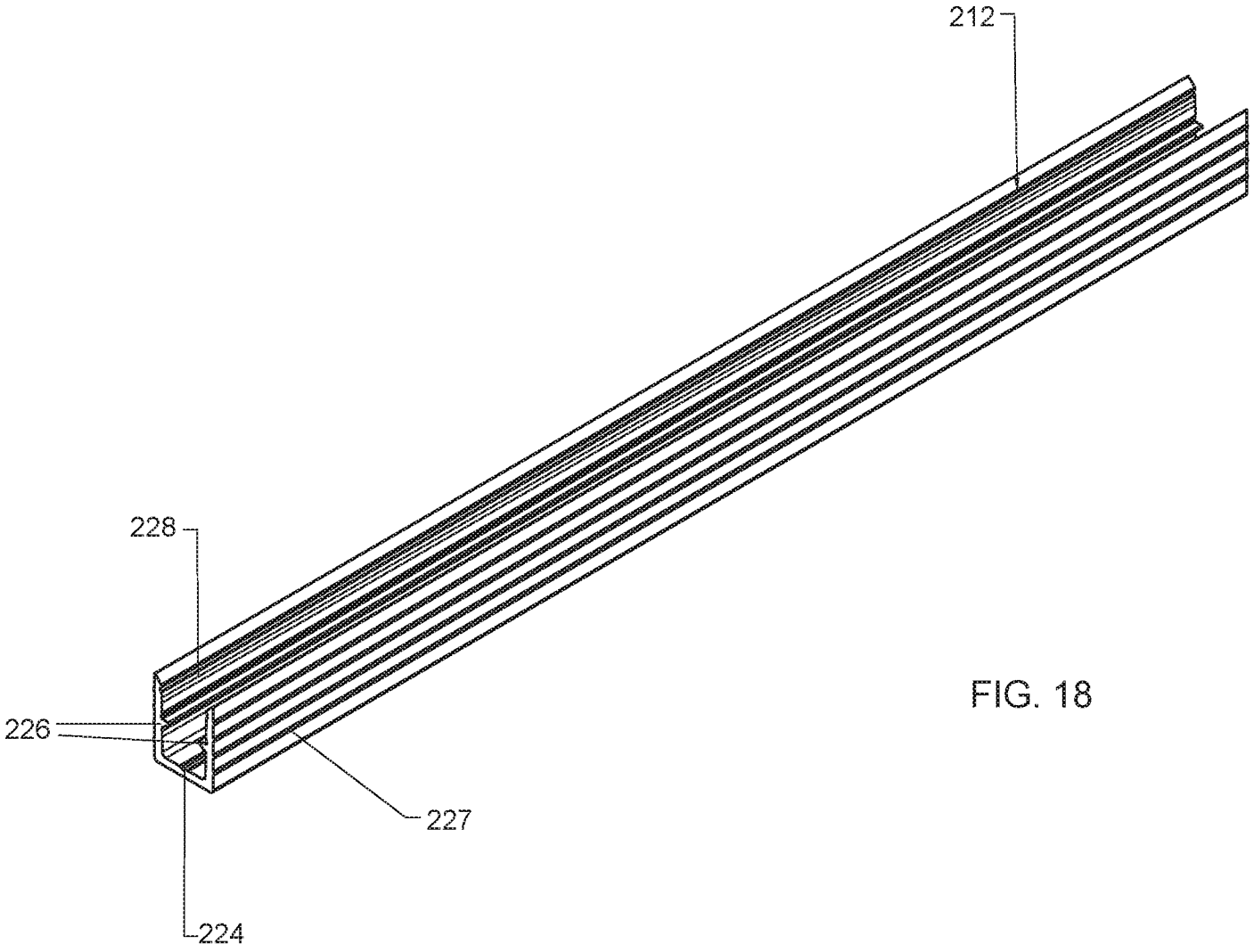
FIG. 18 is a top isometric view of an exemplary channel according to another exemplary aspect of the present invention.

Referring now to FIG. 18, a channel 212 according to another exemplary aspect of the present invention will be discussed with the understanding that the channel 212 is suitable for use with the lighting fixture 10 discussed above. The channel 212 may be made from a plastic, such as polyvinyl chloride (PVC), or other easily field cuttable material. However, it is understood that the channel 212 according to aspects of the present invention is not limited to plastics and/or field cuttable materials. For example, the channel 212 may be made from metals, such as aluminum. The channel 212 may include a recessed track 224 positioned in the base of the channel 212 and running at least partially the length of the channel 212. The recessed track 224 is configured to facilitate mounting of the channel 212 within the railing (not shown) by acting as an indent within the channel 212 for positioning of the one or more fasteners (not shown). The channel 212 may also include one or more sets of extensions 226 protruding into the interior region of the channel 212 and configured to act as a base for the mounting tray 18 as discussed above with respect to lighting fixture 10. The channel 212 may also include one or more furrows 228 positioned between the extensions 226 and opening of the channel 212 configured to interlock with and facilitate retention of the lens 22, as discussed above with respect to lighting fixture 10, within the channel 212. The channel 212 may also include one or more longitudinal grooves 227 positioned on one or more exterior surfaces of the channel 212 and configured to provide additional hold between the channel 212 and railing.

Figure 19:
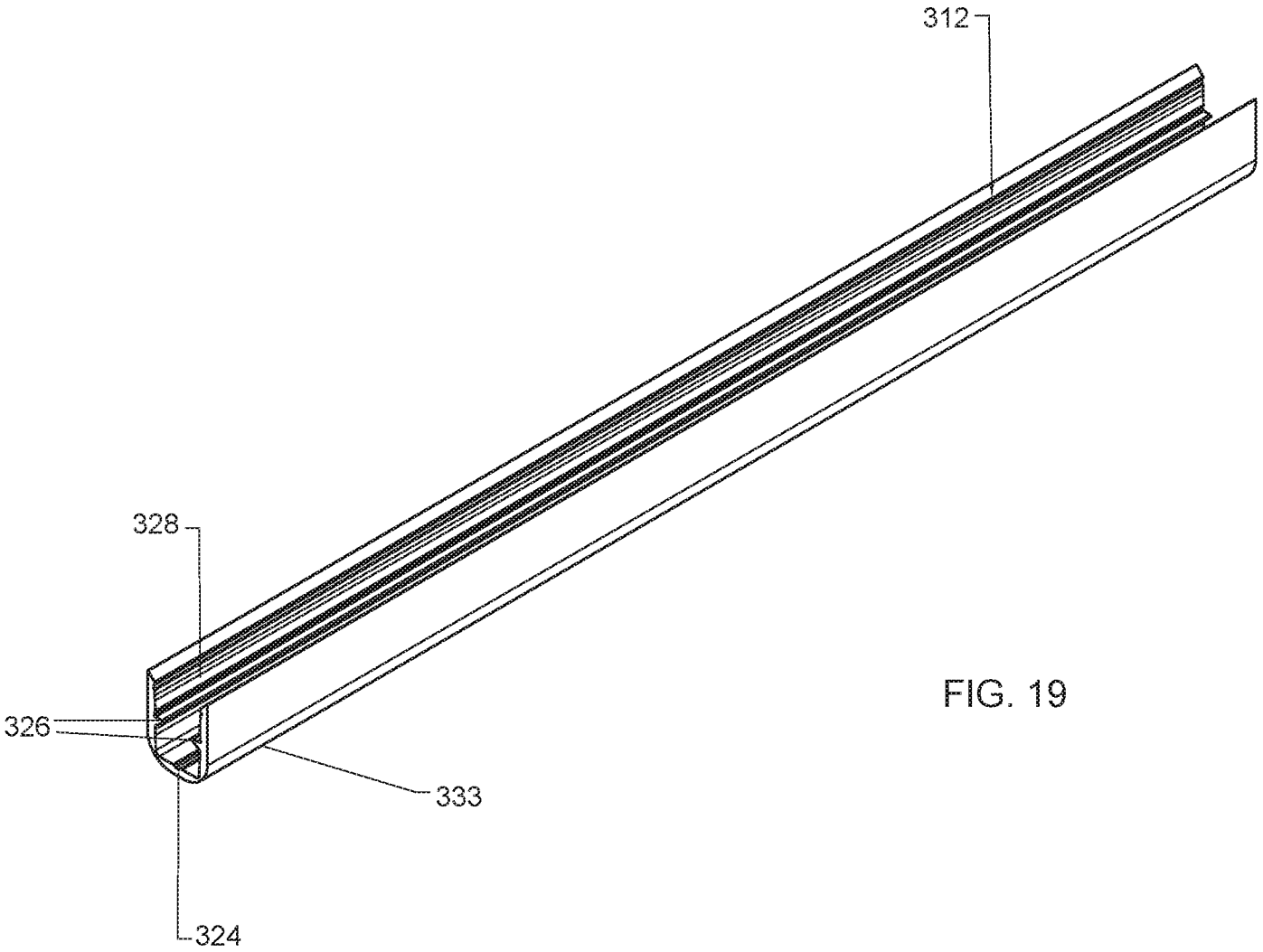
FIG. 19 is a top isometric view of an exemplary channel according to another exemplary aspect of the present invention.

Referring now to FIG. 19, a channel 312 according to another exemplary aspect of the present invention will be discussed with the understanding that the channel 312 is suitable for use with the lighting fixture 10 discussed above. The channel 312 is similar to the channel 12 discussed above, but includes a rounded bottom 333 to provide for interoperability between other railings besides the particular railings previously discussed. The channel 312 may be made from a plastic, such as polyvinyl chloride (PVC), or other easily field cuttable material. However, it is understood that the channel 312 according to aspects of the present invention is not limited to plastics and/or field cuttable materials. For example, the channel 312 may be made from metals, such as aluminum. The channel 312 may include a recessed track 324 positioned in the base of the channel 312 and running at least partially the length of the channel 312. The recessed track 324 is configured to facilitate mounting of the channel 312 within the railing (not shown) by acting as an indent within the channel 312 for positioning of the one or more fasteners (not shown). The channel 312 may also include one or more sets of extensions 326 protruding into the interior region of the channel 312 and configured to act as a base for the mounting tray 18 as discussed above with respect to lighting fixture 10. The channel 312 may also include one or more furrows 328 positioned between the extensions 326 and opening of the channel 212 configured to interlock with and facilitate retention of the lens 22, as discussed above with respect to lighting fixture 10, within the channel 312.

Figure 20:
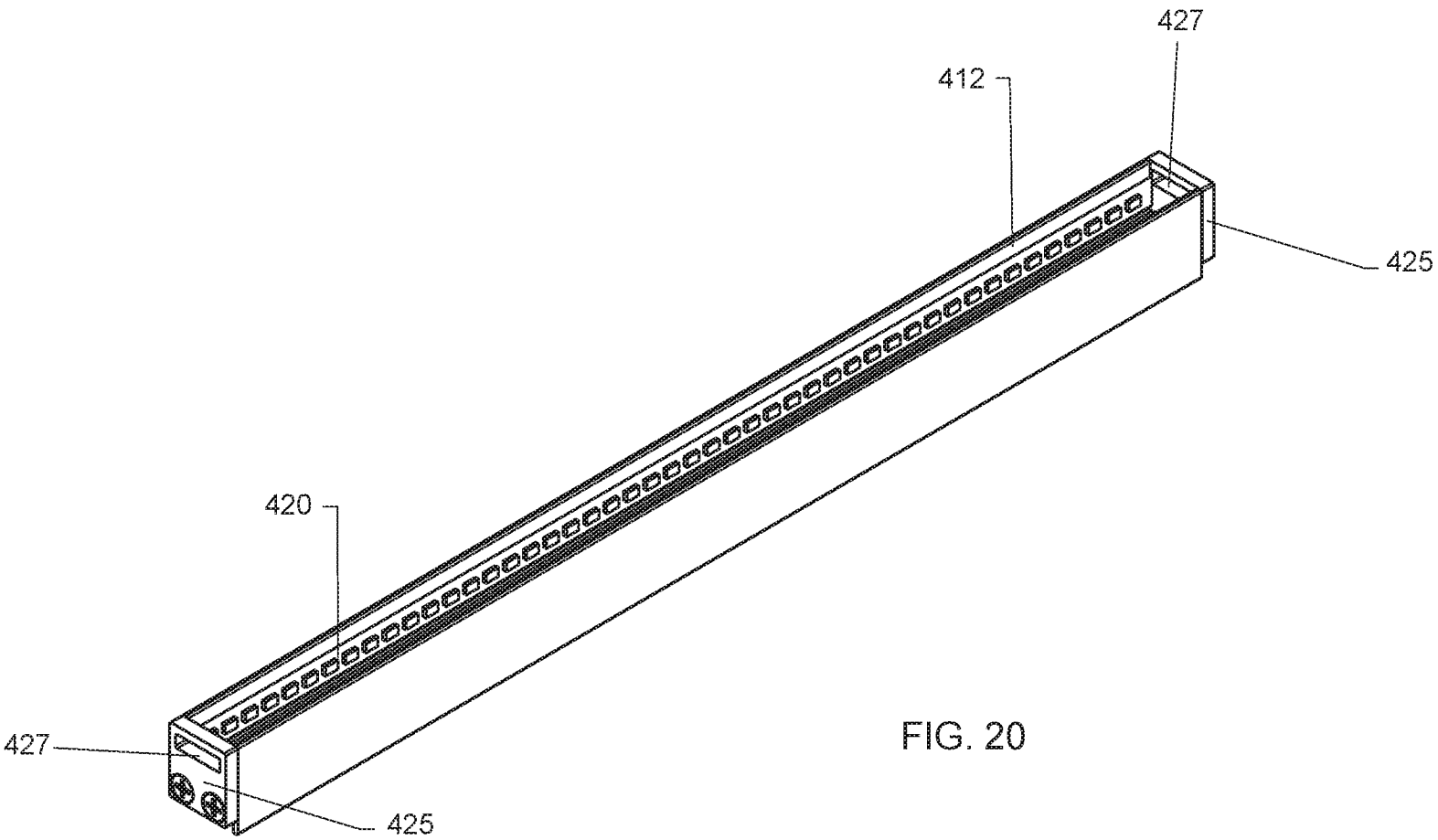
FIG. 20 is a top isometric view of an exemplary channel according to another exemplary aspect of the present invention.

Referring now to FIG. 20 a channel 412 according to another exemplary aspect of the present invention will be discussed with the understanding that the channel 412 is suitable for use with the lighting fixture 10 discussed above. The channel 412 is similar to the channel 12 discussed above, but provides for mounting of a lighting element 420 on a side of the channel 412 to provide asymmetrical light output. The channel 412 may also be configured for use with one or more endcaps 425 that may be affixed to the channel 412, and allow for interlocking of the endcaps 425 with a mounting bracket (not shown) that engages with an opening 427 in the endcaps 425. The opening 427 of the endcaps 425 engages with the mounting bracket (not shown) as the channel 412 is positioned within the railing 14 in which the one or more mounting brackets (not shown) have already been installed.

Figure 21:
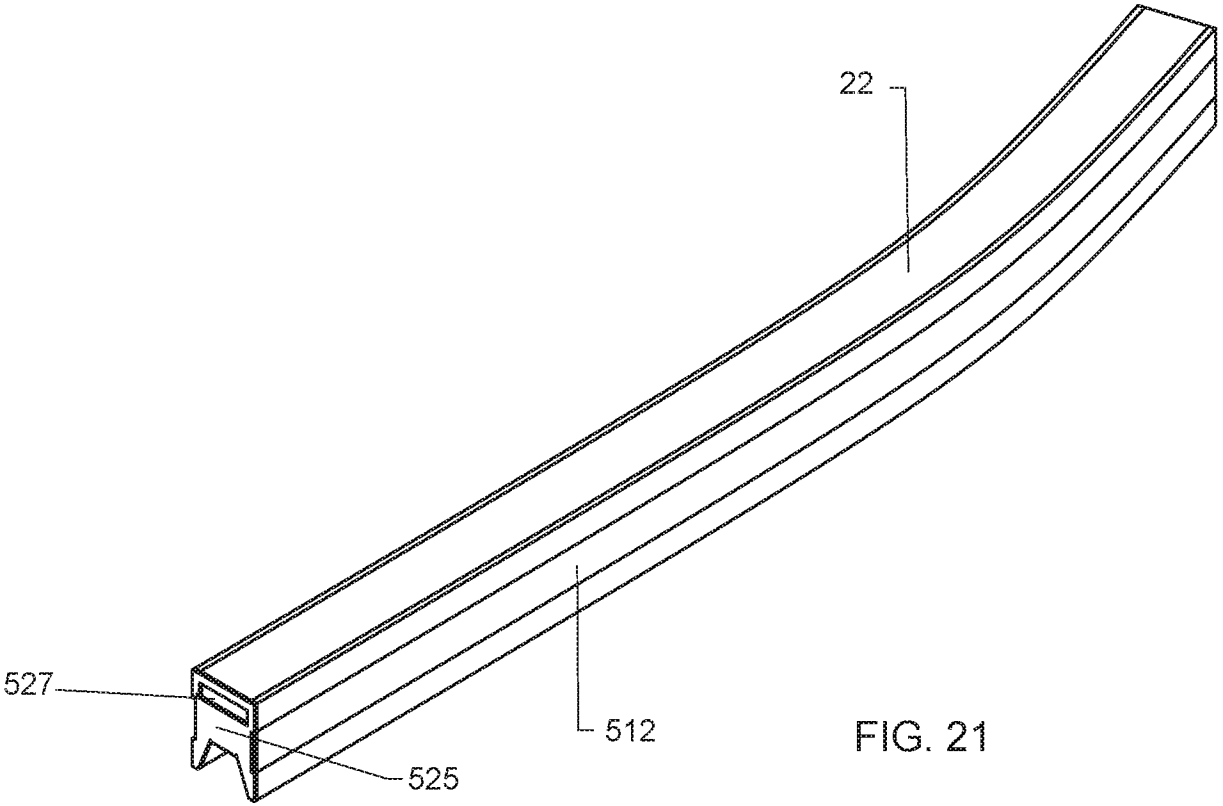
FIG. 21 is a top isometric view of an exemplary channel according to another exemplary aspect of the present invention.

Referring now to FIG. 21 a channel 512 according to another exemplary aspect of the present invention will be discussed with the understanding that the channel 512 is suitable for use with the lighting fixture 10 discussed above. The channel 512 is similar to the channel 12 discussed above, but may be constructed of a flexible material that allows the channel 512 to contour to the shape of the railing. The channel 512 may also be configured for use with one or more endcaps 525 that may be affixed to the channel 512, and allow for interlocking of the endcaps 525 with a mounting bracket (not shown) that engages with an opening 527 in the endcaps 525. The opening 527 of the endcaps 525 engages with the mounting bracket (not shown) as the channel 512 is positioned within the railing 14 in which the one or more mounting brackets (not shown) have already been installed. The channel 512 may also include an undercarriage wire way that allows one or more conductors of the lighting element used for the lighting fixture to travel along the channel 512 and railing. A flexible lens 22 may be disposed within the channel 512.

Figure 22:
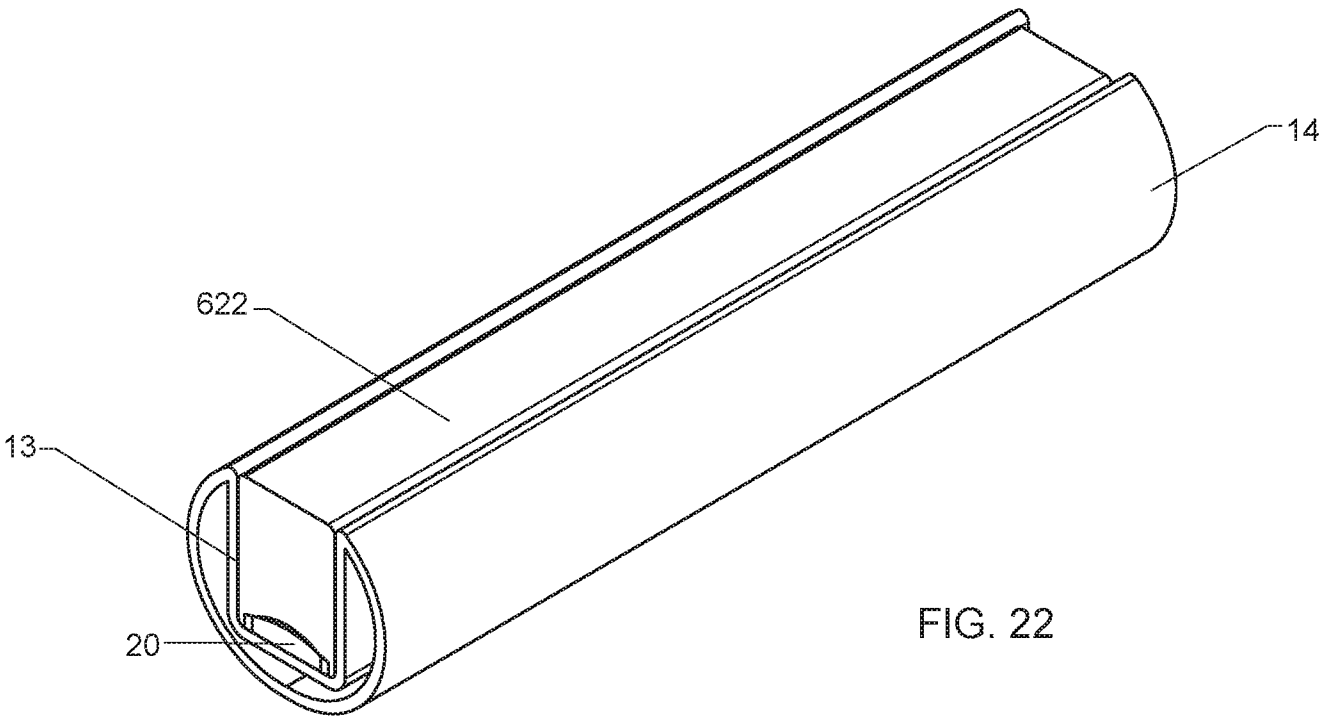
FIG. 22 is a top isometric view of an exemplary lighting fixture according to an exemplary aspect of the present invention.

FIG. 22 shows an exemplary embodiment in which the lighting element may be positioned within the railing and a lens 622 is used to substantially fill up the groove 13 formed in the railing 14. The lens 622 may be dimensioned so as to be press fitted into the groove 13 of the railing 14, but it is understood that the lens 622 may be secured within the groove 13 by a suitable adhesive. The lens 622 substantially fills the groove 13 such that a channel is not necessarily needed in this exemplary embodiment of the present invention.

It will thus be seen that the objects set forth above, among those made apparent from the preceding description, are efficiently attained and, since certain changes may be made in the above article without departing from the scope of this invention, it is intended that all matter contained in this disclosure or shown in the accompanying drawings, shall be interpreted, as illustrative and not in a limiting sense. It is to be understood that all of the present figures, and the accompanying narrative discussions of corresponding embodiments, do not purport to be completely rigorous treatments of the invention under consideration. It is to be understood that the above-described arrangements are only illustrative of the application of the principles of the present invention. Numerous modifications and alternative arrangements may be devised by those skilled in the art without departing from the scope of the present invention.

What is claimed is:

1. A lighting fixture, comprising:

a channel having a bottom portion, a pair of side portions extending from the bottom portion, and an opening formed between the side portions opposite the bottom portion;

a lighting element disposed within the channel; and a lens at least partially covering the lighting element;

wherein the channel of the lighting fixture is configured for disposition within a groove that encloses at least the bottom portion, and at least a portion of the pair of side portions;

wherein the channel of the lighting fixture is configured for attachment to the groove; and wherein the bottom portion is comprised of a platform and a pair of extensions, wherein each extension extends substantially parallel to the corresponding side portion, and an aperture is formed between the extensions on an opposite side of the bottom portion from the opening.

2. The lighting fixture according to claim 1, wherein the groove is disposed within a hand railing.

3. The lighting fixture according to claim 1, wherein the lighting fixture further comprises a mounting tray disposed within the channel and configured to retain the lighting element positioned thereon.

4. The lighting fixture according to claim 1, wherein the lens is made from a flexible material.

5. The lighting fixture according to claim 1, further comprising one or more furrows extending at least partially along at least one of the pair of side portions of the channel.

6. The lighting fixture according to claim 5, wherein the lens is made from a flexible material, and the one or more furrows are configured to engage with and retain the lens in the channel.

7. The lighting fixture according to claim 1, further comprising one or more sets of extensions extending from each side of the pair of sides, wherein each of the one or more sets of extensions is configured to support a mounting tray disposed within the channel.

8. The lighting fixture according to claim 7, wherein the mounting tray is configured to retain the lighting element thereon, and wherein a wire way is formed in the channel between the mounting tray and the bottom of the channel.

9. The lighting fixture according to claim 1, wherein the lighting fixture is configured for attachment to the groove through the use of one or more fasteners.

10. The lighting element according to claim 1, wherein the lighting fixture is configured for attachment to the groove through the use of one or more mounting brackets.

11. The lighting fixture according to claim 10, wherein the one or more mounting brackets are secured to the channel through the use of one or more fasteners.

12. The lighting fixture according to claim 10, wherein the one or more mounting brackets are configured for engagement with one or more endcaps affixed to the channel.

13. The lighting fixture according to claim 1, further comprising one or more teeth extending at least partially along at least one of the pair of side portions of the channel.

14. The lighting fixture according to claim 13, wherein the lens is made from a flexible material, and the one or more furrows are configured to engage with and retain the lens in the channel.

15. The lighting fixture according to claim 1, wherein the channel comprises one or more longitudinal grooves positioned on an exterior area of at least one of the pair of side portions.

16. The lighting fixture according to claim 1, wherein the channel further comprises a rounded transition between each of the pair of side portions and the bottom portion.

17. The lighting fixture according to claim 1, wherein the lighting element is disposed on one of the side portions.

18. The lighting fixture according to claim 1, wherein the channel is comprised of a flexible material.

19. The lighting element according to claim 1, wherein the channel is comprised of a plastic.

20. The lighting element according to claim 1, wherein the lighting element is flexible.

* * * * *